US005679042A

United States Patent [19]

Varona

[11] Patent Number: 5,679,042

[45] Date of Patent: Oct. 21, 1997

[54] NONWOVEN FABRIC HAVING A PORE SIZE GRADIENT AND METHOD OF MAKING SAME

[75] Inventor: Eugenio Go Varona, Marietta, Ga.

[73] Assignee: Kimberly-Clark Worldwide, Inc., Irving, Tex.

[21] Appl. No.: 637,998

[22] Filed: Apr. 25, 1996

[51] Int. Cl.[6] ..... B32B 5/14; B32B 5/26; B32B 31/26; D04H 3/05; D04H 3/16

[52] U.S. Cl. ..... 442/347; 26/18.5; 156/84; 425/72.2; 425/83.1; 428/310.5; 428/311.51; 428/315.5; 442/351; 442/362; 442/363; 442/364; 442/414

[58] Field of Search ..... 26/18.5; 156/84; 428/310.5, 311.51, 315.5; 425/72.2, 83.1; 442/347, 351, 362, 363, 364, 414

[56] References Cited

U.S. PATENT DOCUMENTS

| | | | |
|---|---|---|---|
| 2,952,260 | 9/1960 | Burgeni | 128/290 |
| 3,224,446 | 12/1965 | Gore | 128/284 |
| 3,565,729 | 2/1971 | Hartmann | 156/441 |
| 3,689,342 | 9/1972 | Vogt et al. | 156/167 |
| 3,692,618 | 9/1972 | Dorschner et al. . | |
| 3,752,613 | 8/1973 | Vogt et al. | 425/80 |
| 3,795,571 | 3/1974 | Prentice . | |
| 3,811,957 | 5/1974 | Buntin | 136/146 |
| 3,849,241 | 11/1974 | Butin et al. . | |
| 3,888,257 | 6/1975 | Cook et al. | 128/296 |
| 3,978,185 | 8/1976 | Buntin et al. | 264/93 |
| 4,041,203 | 8/1977 | Brock et al. | 428/157 |
| 4,112,167 | 9/1978 | Dake et al. | 428/154 |
| 4,340,563 | 7/1982 | Appel et al. | 264/518 |
| 4,375,446 | 3/1983 | Fujii et al. | 264/518 |
| 4,405,297 | 9/1983 | Appel et al. | 425/72 S |
| 4,656,081 | 4/1987 | Ando et al. | 428/233 |
| 4,692,371 | 9/1987 | Morman et al. | 428/224 |
| 4,713,069 | 12/1987 | Wang et al. | 604/378 |
| 4,738,675 | 4/1988 | Buckley et al. | 604/380 |
| 4,921,659 | 5/1990 | Marshall et al. | 264/510 |
| 4,927,582 | 5/1990 | Bryson | 264/113 |
| 4,931,357 | 6/1990 | Marshall et al. | 428/284 |
| 4,999,232 | 3/1991 | LeVan | 428/113 |
| 5,039,431 | 8/1991 | Johnson et al. | 264/113 |
| 5,075,068 | 12/1991 | Milligan et al. | 264/555 |
| 5,143,680 | 9/1992 | Molnar et al. | 264/511 |
| 5,227,107 | 7/1993 | Dickenson et al. | 264/113 |
| 5,330,456 | 7/1994 | Robinson | 604/368 |
| 5,350,370 | 9/1994 | Jackson et al. | 604/367 |
| 5,382,400 | 1/1995 | Pike et al. | 264/168 |

OTHER PUBLICATIONS

NRL Report 4364, "Manufacture of Superfine Organic Fibers" by V. A. Wente, E. L. Boone and C. D. Fluharty.

*The Textile and Research Journal*, Burgeni and Kapur, vol. 37 (1967), p. 356.

*Primary Examiner*—James C. Cannon

*Attorney, Agent, or Firm*—William D. Herrick

[57] ABSTRACT

Methods and apparatus for forming a nonwoven fiber web containing a pore size gradient resulting in enhanced wicking properties. A first method utilizes a conventionally formed web having an average pore size and comprises selectively contacting the web with a heat source to shrink the fibers in selected areas. The smaller pore sizes have greater wicking ability. A second method utilizes a novel apparatus and comprises forming a nonwoven fiber web having zones of fibers, each zone having generally an average set of fiber structure and/or composition, the zones preferably overlapping. The zones of fibers are exposed to a heat source, which shrinks the fibers according to their denier and composition.

The apparatus uses a conventional meltblown or spunbond system and provides a plurality of resin sources which feed resin to a plurality of meltblowing dies. Each die produces fibers of a particular denier and/or composition which forms zones in a web collected on a collecting belt. The web moves underneath a manifold which blows heated air or sprays boiling water onto the fibers. The fibers shrink according to their structure and composition to form a web having a pore gradient.

45 Claims, 7 Drawing Sheets

NONWOVEN FABRIC HAVING A PORE SIZE GRADIENT AND METHOD OF MAKING SAME

FIELD OF THE INVENTION

The present invention relates generally to a fibrous nonwoven web having a pore size gradient, and methods for forming such a web. The method of the present invention uses, in one embodiment, a formed web having an average pore size and selectively subjecting it to heat in order to shrink portions of the fibers, thus forming smaller pores in the selected areas. In a second embodiment, a web is formed of different fiber diameters or fiber compositions. Subjecting the web to heat uniformly shrinks the different diameter fibers or composition to different degrees, thus forming a pore size gradient across the web.

BACKGROUND OF THE ART

The manufacture of nonwoven fabrics is a highly developed art. In general, nonwoven webs or webs and their manufacture involve forming filaments or fibers and depositing them on a carrier in such a manner so as to cause the filaments or fibers to overlap or entangle as a web of a desired basis weight. The bonding of such a web may be achieved simply by entanglement or by other means such as adhesive, application of heat and pressure to thermally responsive fibers, or, in some cases, by pressure alone. While many variations within this general description are known, two commonly used processes are defined as spunbonding and meltblowing. Spunbonded nonwoven structures and their manufacture are defined in numerous patents including, for example, U.S. Pat. No. 3,565,729 to Hartmann dated Feb. 23, 1971, U.S. Pat. No. 4,405,297 to Appel et al. dated Sep. 20, 1983, and U.S. Pat. No. 3,692,618 to Dorschner et al. dated Sep. 19, 1972. Discussion of the meltblowing process may also be found in a wide variety of sources including, for example an article entitled, "Superfine Thermoplastic Fibers" by Wendt in *Industrial and Engineering Chemistry*, Volume 48, No. 8 (1956) pp. 1342–1346, as well as U.S. Pat. No. 3,978,185 to Buntin et al. dated Aug. 31, 1976, U.S. Pat. No. 3,795,571 to Prentice dated Mar. 5, 1974, and U.S. Pat. No. 3,811,957 to Butin dated May 21, 1974.

For the purposes of the present disclosure the term "composition" shall mean the chemical makeup of a fiber. The term "structure" shall mean the physical characteristics of the fiber, including, but not limited to denier, length, crimping, kinking, number of components (such as bi- or multi-component fibers, discussed in more detail hereinbelow), and strength.

Among the characteristics of the fiber web produced by either a meltblown or a spunbonded process are the fiber diameter, also known as the "denier" of the fiber and the wicking power of the fabric, which relates to the ability of the web to pull moisture from an area of application. The ability to wick moisture is related to the denier of the fiber and the density of the web, which defines the pore size in the material. Wicking is caused by the capillary action of the fibers in contact with one another. The pulling or capillary action is inversely related to the pore size or capillaries in the web. Therefore, the smaller the capillary the higher the pressure and the greater the pulling or wicking power.

It has been found useful to create a fabric having a composition containing a pore size gradient over a given area of the fabric. An advantage of this is greater control over fluid wicking in target areas. Several patents have attempted to address methods of creating nonwoven fabrics of variable pore size.

U.S. Pat. No. 4,375,446 to Fujii et al. discloses a meltblown process in which fibers are blown into a valley created between two drum plates having pores. One drum is a collection plate and the other drum is a press plate; the fibers are pressed between the two drums. The angle at which the fibers are shot into the valley is discussed as creating webs of varying characteristics.

U.S. Pat. No. 4,999,232 to LeVan discloses a stretchable batting composed of differentially-shrinkable bicomponent fibers, which form cross-lapping webs at determined angles. The angle determines the degree of stretch in the machine direction and cross direction. A helical crimp is induced into the material by the differential shrinking.

U.S. Pat. No. 2,952,260 to Burgeni discloses an absorbent product, such as a sanitary napkin, having three layers of webs folded over each other, each layer has different shaped bands of porous zones of compacted or uncompacted fibers.

U.S. Pat. No. 4,112,167 to Dake et al. discloses a web including a wiping zone having a low density and high void volume. The low density zone is heated with a lipophilic cleansing emollient. The web is made by drying two layers of slurry formed webs.

U.S. Pat. No. 4,713,069 to Wang et al. discloses a baffle having a central zone having a water vapor transmission rate less than that of non-central zones of the baffle. The baffle can be formed by melt blowing or a laminate of spun bonded web layers, or by coating the central zone with a composition.

U.S. Pat. No. 4,738,675 to Buckley et al. discloses a multiple layer disposable diaper having compressed and uncompressed regions. The compressed regions can be created by embossing by rollers.

U.S. Pat. Nos. 4,921,659 and 4,931,357 to Marshall et al. disclose a method of forming a web using a variable transverse webber. Two independent fiber sources (one short fiber, one long fiber) are rolled and fed by feed rolls to a central mixing zone. The relative feed rates of the feed rolls is controllable to alter the fiber composition of the web formed therefrom.

U.S. Pat. No. 4,927,582 to Bryson discloses a graduated distribution of granule materials in a fiber web, which is formed by introducing a high-absorbency material whose flow is regulated into a flow of fibrous material which intermix in a forming chamber. The controllable flow velocity permits selective distribution of high-absorbency material within the fibrous material deposited onto the forming layer.

U.S. Pat. No. 5,227,107 to Dickenson et al. discloses a multi-component nonwoven made by directing fibers from a first and a second fiber source throughout a forming chamber such that they mix to form a relatively uniform fibrous precursor which is then deposited from the forming chamber onto a forming surface such that a fibrous nonwoven web is made which is a mixture of the first and second fibers.

U.S. Pat. No. 5,330,456 to Robinson discloses an absorbent panel having a fibrous absorbent panel layer of super absorbent polymer (SAP) and a liquid transfer layer, the latter of which is positioned above the SAP layer.

Fabrics created by multilayer processes can have transfer difficulties between layers due to the inter-layer barrier caused by imperfect wicking between the layers. Fabrics created by differential compression of various areas are also undesirable because alternating areas of high and low density slows down liquid transport.

It would be desirable to have a method of creating a variable pore size material that could utilize existing methods of creating the web. Such a web would have improved flow and wicking characteristics that would enhance a fluid absorbing product's ability to absorb fluid in a target area and wick the fluid rapidly away to distant areas. Such a web would have enhanced wicking rates and capacities.

SUMMARY OF THE INVENTION

The present invention provides methods of forming a nonwoven web having a pore size gradient created from thermally responsive fibers.

In a first preferred embodiment, the present invention provides a web made in a conventional manner having an average pore size. The web can be formed using conventional meltblown, spunbonding, airforming, wetforming or other processes known to those skilled in the art. The web can be cut into a wedge or other shape and the material is selectively exposed to heat so as to selectively shrink certain areas of the web. The heat source can be heated water, oil or other liquid, such as in the form of a spray, a solid, such as a heated roller or gear, a radiated heat source, such as incandescent (incoherent) or laser (coherent) light, ultraviolet light, microwave energy, or other electromagnetic radiation. The wider areas of the web are exposed to more heat than the narrower areas, resulting in a rectangular-shaped web having a pore gradient. Various shaped webs can be employed prior to heating, depending on the shape of the end product desired.

In a second preferred embodiment, the present invention provides a method and apparatus for forming a nonwoven web having overlapping or discrete zones of different structure and/or composition of fiber. In a meltblown process, after the fibers are formed and deposited onto a collection belt. The fibers are exposed to a generally uniformly applied heat source, such as hot air, heated solid or liquid blown or sprayed across the width of the formed web. The fibers shrink according to the characteristics of the fiber structure and composition, forming a web having a pore size gradient.

An apparatus for achieving the method of the second preferred embodiment using a meltblown process comprises at least one reservoir capable of containing a supply of at least one polymer resin (commonly provided in pellet form), each reservoir being in communication with a meltblowing die. A foraminous conveyor belt disposed below the die receives attenuated fiber streams exiting the die tip. A heat source, such as a hot air blower or liquid pump is in communication with a manifold disposed across at least a portion of the width of the conveyor belt. The manifold has at least one aperture located on the bottom portion that can blow hot air or spray liquid on the fiber web as it passes underneath the manifold while on the conveyor belt. An air filter can optionally be disposed between the hot air source and the manifold or at the hot air source for filtering contaminants. Optionally, a reservoir containing fibers or other particles can be in communication with the manifold for blowing the fibers or particles onto the fiber web with the hot air, which can provide additional control over structural and functional properties by changing the composition of the material prior to shrinking. In the case of a fluid heat source, the fluid, such as water, is removed from the web using conventional means, such as a vacuum source.

In a third embodiment, the second preferred embodiment method can be used employing a spunbonding apparatus, as is conventionally known, and adding the manifold and heat source as previously described.

In a fourth embodiment, meltblown and spunbond processes are used in conjunction to create a composite layered web, such as spunbond-meltblown-spunbond webs, which are known in the art and produced by the assignee of the present invention.

It is also possible to use multi-component fibers, such as, but not limited to sheath/core, eccentric sheath/core, side by side (bi-component), side by side by side (tri-component) or other known multi-component structures and compositions.

Accordingly, it is an object of the present invention to provide a method and apparatus for forming a nonwoven web having a variable pore size gradient.

It is another object of the present invention to provide a method for forming a fiber web having a pore size gradient by contacting a fiber web having an average pore size with a heat source to selectively shrink the fibers.

It is still another object of the present invention to provide a method for forming a fiber web having a pore size gradient by contacting a fiber web composed of different fiber denier or other structural characteristics with a heat source to selectively shrink the fibers.

It is still another object of the present invention to provide a method for forming a fiber web having a pore size gradient by contacting a fiber web composed of zones of fibers, each zone containing a fiber of a distinct composition or structure, the zones possibly overlapping, with a heat source to selectively shrink the fibers.

It is yet another object of the present invention to provide a method for forming a fiber web of a different web composition or structure, using fiber and particle introduction to control composition and structure.

Other objects, features, and advantages of the present invention will become apparent upon reading the following detailed description of embodiments of the invention, when taken in conjunction with the accompanying drawings and the appended claims.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

The present invention can be employed to produce nonwoven fiber webs having controlled pore gradient distribution created using thermally responsive fibers. The preferred embodiments of the invention set forth methods of and apparatus for applying heat or other force which selectively causes fibers to shrink.

With all the embodiments of the present invention the polymer used can be any suitable thermoplastic material such as, but not limited to, polymers and copolymers of ethylene, propylene, ethylene terephthalate, mixtures thereof and the like. The polymer should exhibit the property of being shrinkable. Such materials are known to those skilled in the art and need not be reviewed in detail. Theoretically, any thermoplastic polymer known to those skilled in the art will exhibit heat-shrinkability properties if it is first oriented (as in a fiber spinning process) and then solidified so as to "freeze-in" the orientation. Subsequent application of heat will cause the material to shrink to relieve the stresses induced in the orientation process. Additionally, the fibers formed can be standard monofilament, monocomponent fibers, or, can be multi-component fibers, such as, but not limited to sheath/core, eccentric sheath/core, side-by-side (bi-component), islands-in-the-sea (tri-component), or the like. For a description of these and other multi-component fibers, see U.S. Pat. No. 5,382,400, issued to Pike et al. (which is incorporated by reference herein) and assigned to the assignee of the present invention.

In a first preferred embodiment of the invention, shown in FIGS. 1–4, a portion of a nonwoven fiber web 10 has a substantially uniform pore size distribution defined by fibers or filaments 12. The terms fiber and filament are synonymous, as are the terms web and fabric and may be used interchangeably herein. The web 10 is created using standard meltblown or spunbond techniques known in the art, which need not be reviewed in detail. Briefly, however, in a meltblown process, an amount of polymer resin pellets is passed through an extruder by a screw conveyor and then through a meltblown die having multiple fine apertures. The molten resin is forced through the apertures to form fibers. The fibers are attenuated and broken up by being contacted by heated drawing air and are collected as an entangled web on a moving surface, such as a foraminous vacuum belt. The fibers are collected from the belt after setting.

Figure 3:
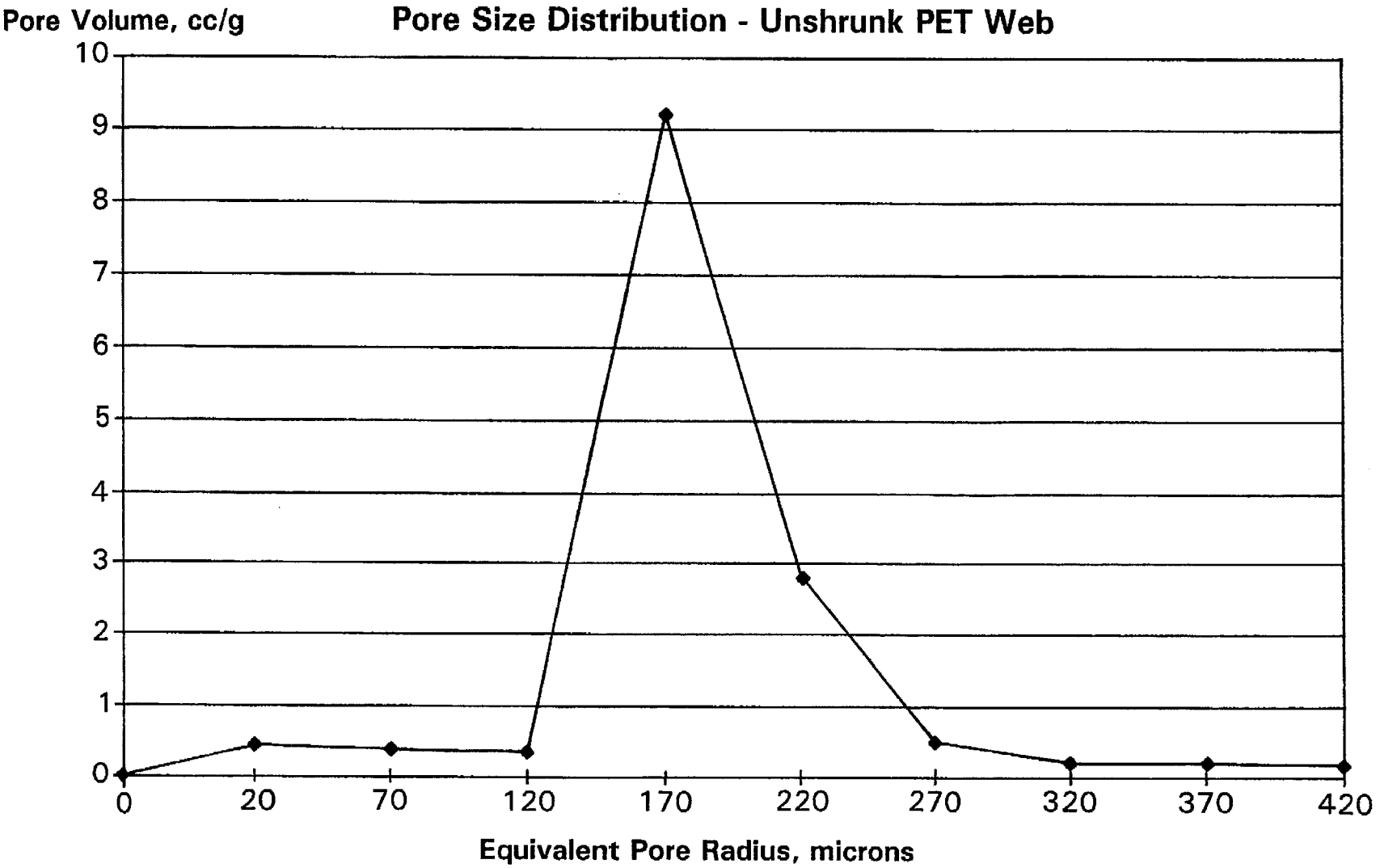
FIG. 3 is a chart showing pore radius distribution of meltblown PET fibers prior to shrinking according to the first preferred embodiment.
Figure 4:
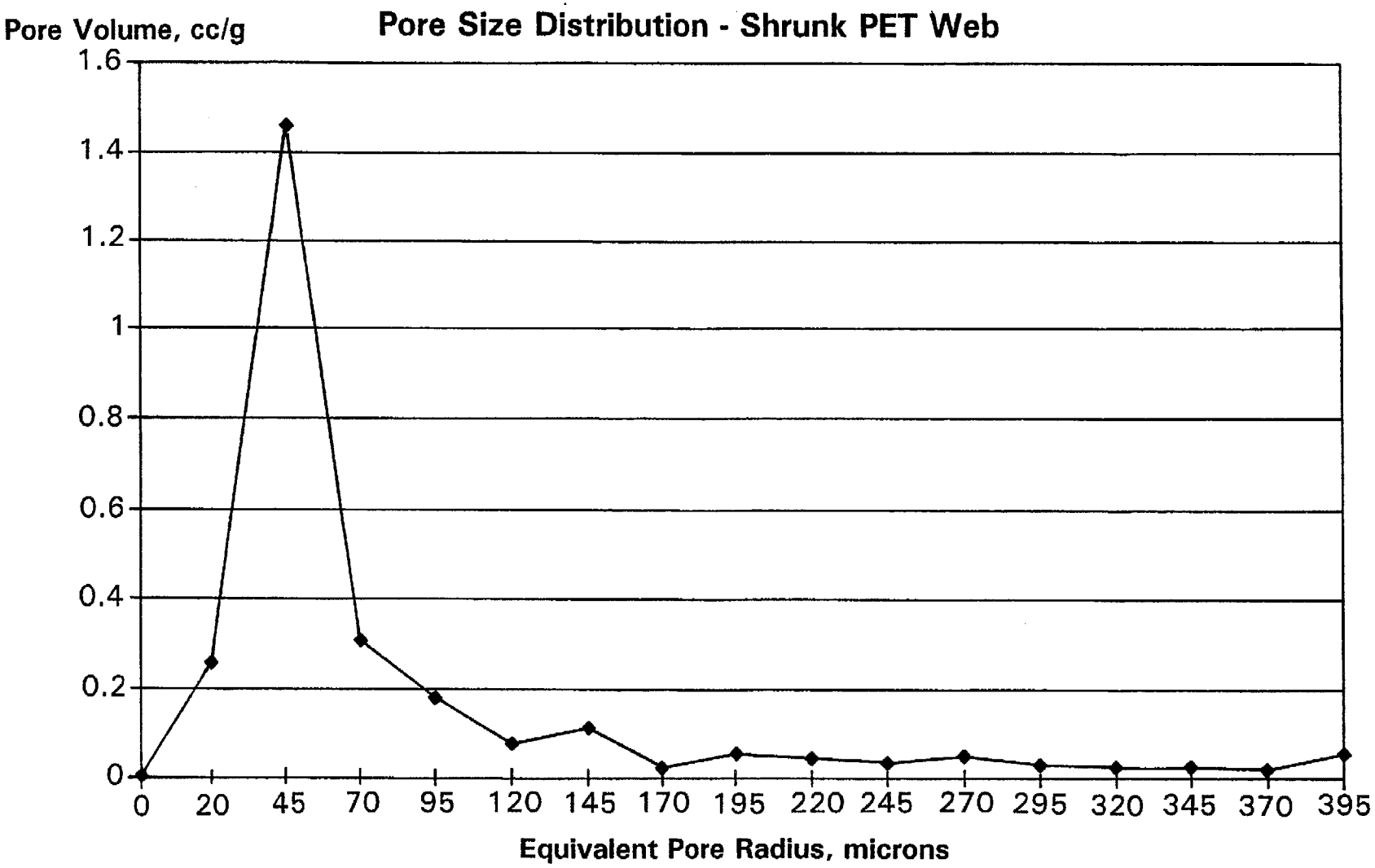
FIG. 4 is a chart showing pore radius distribution of meltblown PET fibers after shrinking according to the first preferred embodiment.

In this first embodiment the meltblown die forms a web of fibers having an average pore size across the width of the web because the die apertures are the same diameter, resulting in the fibers being generally of the same diameter. A sample pore size distribution chart for unshrunk PET fibers formed using a meltblown process is shown in FIG. 3. The pore size can be in the range of about 5μ to about 1000μ in equivalent pore radius, preferably in a range of from about 20μ to about 500μ. Other pore size ranges, prior to and after shrinking, are contemplated as being within the scope of the present invention. Preferably the coefficient of variation is not greater than about 50%. A description of pore size appears in U.S. Pat. No. 5,039,431, issued to Johnson et al., assigned to the assignee of the present invention and incorporated by reference herein. FIG. 4 shows a pore size distribution chart for shrunk PET fibers formed using a meltblown process.

Figure 1:
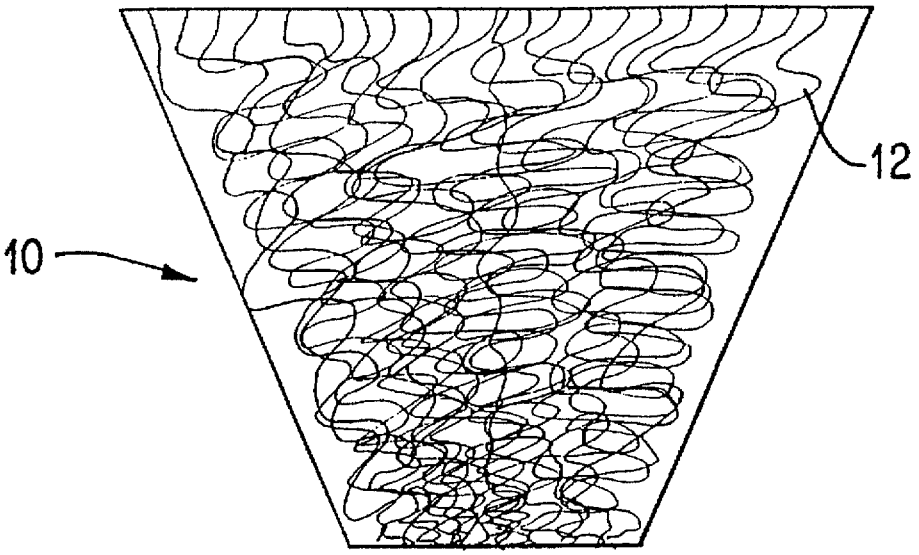
FIG. 1 shows a perspective view of a section of web having an initial homogenous pore size according to a first preferred embodiment of the present invention.
Figure 2:
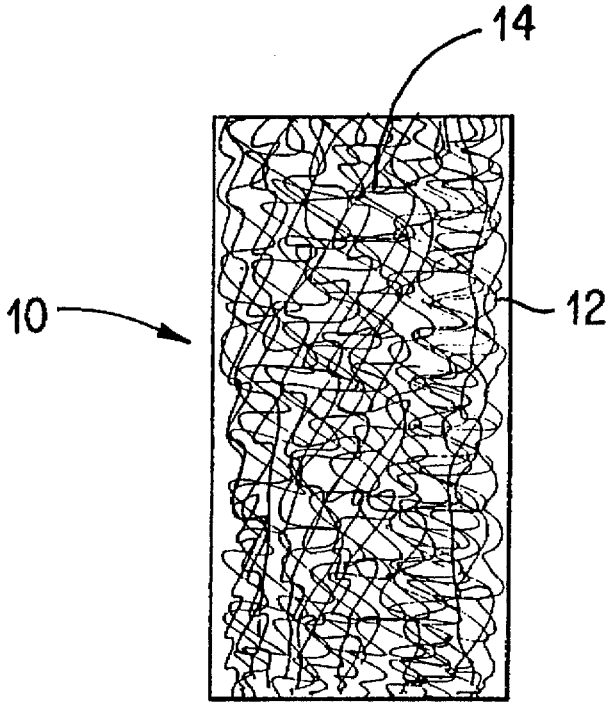
FIG. 2 shows a perspective view of the web of FIG. 2 after exposure to heat.

Preferably, heated air may be blown at the fibers in selected areas to shrink the fibers. FIG. 2, for example, shows the effect of selectively heating zone 14 of the web 10. Fibers or filaments 12 are shrunk and more highly entangled in zone 14 resulting in reduced pore sizes in that zone compared with the remainder of web 10. Factors influencing the amount of shrinkage include, but are not limited to, temperature of the heated air, velocity of the air, distance of the nozzle from the fibers, duration of heat application, makeup of the air itself (e.g., humidity, pH, composition of other vaporized or non-vaporized components) and the like.

Selective shrinkage of the fibers is accomplished by application of heat to the fibers. Alternatively, steam, oil, or other suitable liquid, is contacted with the fibers in selected areas for specific periods of time to shrink the fibers more in some areas and less in other areas. Shrinkage can be controlled by several factors, including, but not limited to, temperature of the heat source applied, composition of the heat source, distance of the heat source applicator from the web, and duration of exposure.

Other factors which may influence shrinkage that may be used with the present invention include, but are not limited to, water, light (UV, laser), pressure, magnetism or other electromotive force, and the like, depending on the fiber and mat composition. It is possible to use fibers having a pH sensitive composition and use acid or alkaline adjusted fluid to control shrinkage.

It is also possible to use microwave energy to heat the fibers. An example of this method can be forming fibers using metal particles as a co-forming material. The impregnated particles will heat upon exposure to microwave or other energy, and thus shrink the fibers. Different concentrations of particles within areas of the web can be achieved by a plurality of different sized die tips or by a plurality of discrete dies or by other techniques known to those skilled in the art. As an alternative to microwave energy, one or more heat rolls can be used to apply heat to the web. Several pairs of heat rolls, between which the web is pressed, can provide a controlled amount of heating, and also set the web, such as in the case of a composite web structure.

Figure 5:
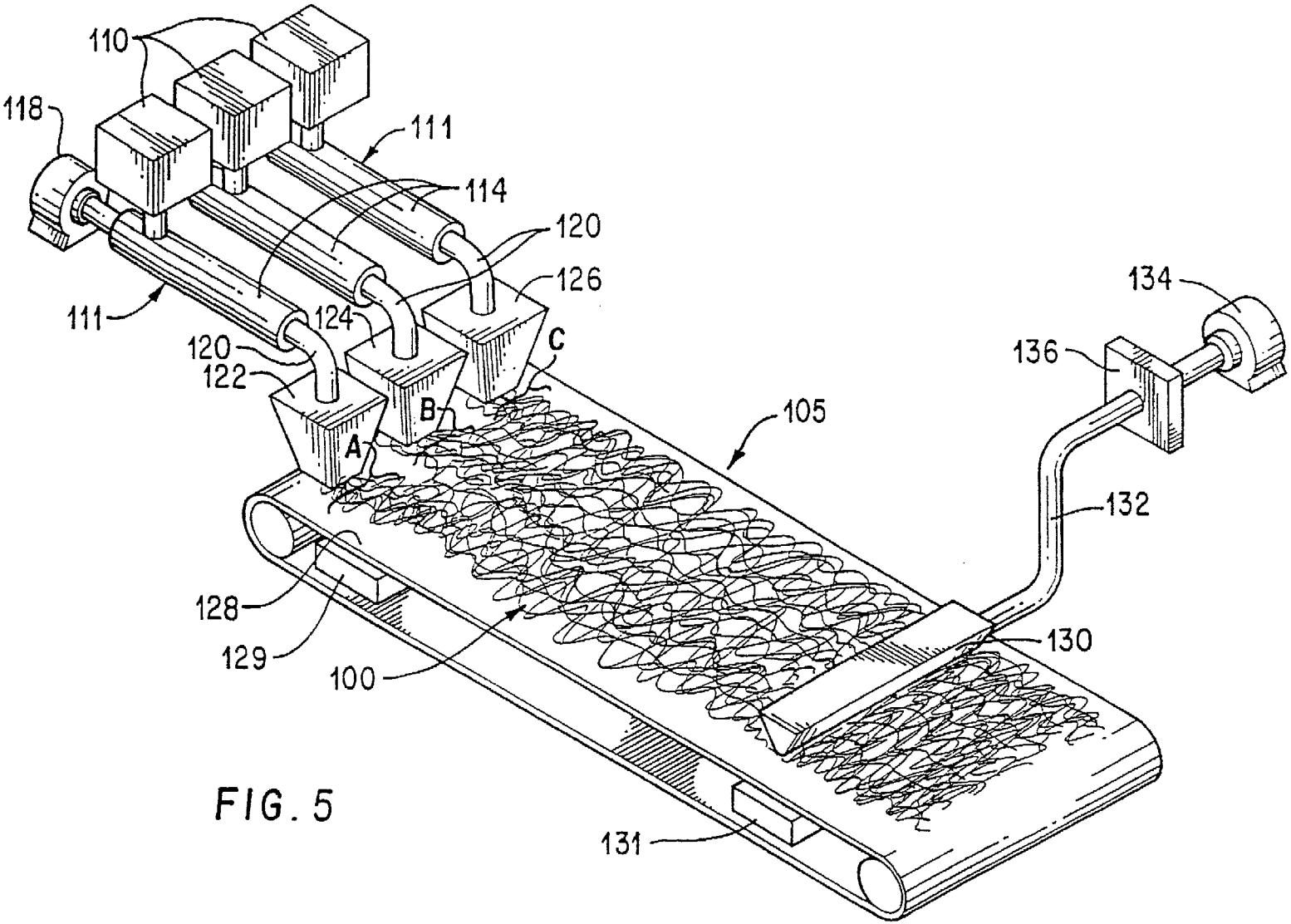
FIG. 5 shows a perspective view of a meltblown apparatus used to form a variable composition fiber web according to a second preferred embodiment of the present invention.

In a second preferred embodiment shown in FIG. 5, a variable composition web 100 having zones of different fiber diameters is preferably formed by a meltblown process. It is to be understood that other processes can be used, such as spunbonding (discussed in more detail hereinbelow) airforming, wetforming, or the like. A meltblown apparatus and process are described in detail in U.S. Pat. No. 5,039,431, issued to Johnson et al, which uses a number of dies to form a layered web. FIG. 5 shows an apparatus 105 has a number of hoppers 110, each containing thermoplastic pellets 112 (not shown) of polymer resin. Each hopper 110 can have a distinct polymer composition, or various hoppers can have the same composition. The following description takes place for each die assembly 111. The pellets 112 are transported to an extruder 114 which contains an internal screw conveyor 116 The screw conveyor 116 (not shown) is driven by a motor 118. The extruders 114 are heated along their length to the melting temperature of the thermoplastic resin pellets 112 to form a melt. The screw conveyors 116 driven by the motors 118 force the molten resin material through the extruder 114 into an attached delivery pipe 120, each of which is connected to a die head 122, 124, and 126. Each die head has a die width. Preferably, the die heads 122, 124, and 126 are spaced close to each other so that the fibers formed therefrom will become entangled. Fibers are produced at the die head tip in a conventional manner, i.e., using high pressure air to attenuate and break up the polymer stream to form fibers at each die head, which fibers are deposited in layers on a moving foraminous belt 128 to form the web 100. A vacuum box 129 is positioned beneath the belt 128 to draw the fibers onto the belt 128 during the meltblowing process. It is possible that one hopper 110 can supply polymer to a plurality of die heads 122, 124, and 126. Alternatively, each hopper 10 can supply a different polymer to each die.

The web 100 thus formed is heated by a manifold 130, which distributes heated air uniformly across the web 100 assisted by a vacuum box 131 to improve uniformity of heating through the web thickness. The heated air enters the manifold 130 by a conduit 132, which is in communication with a heated air source 134. Optionally, an air filter 136 can be inserted downstream from the heat source 134 to reduce contamination of the web 100. In an alternative embodiment, the manifold 130 can have a plurality of discrete areas, each area being supplied by a different heated air source, each source generating heat at a different temperature. In an alternative embodiment, a manifold 130 is positioned beneath the belt 116 and the web 100 and the position of vacuum box 131 is, likewise, reversed.

The web 100 can be quenched to stop the action of heat on the fibers. Once the shrunk fiber web 100 has been created the web 100 can be withdrawn from the belt 128 by conventional withdrawal rolls (not shown). Optionally, conventional calendar rolls (not shown) can engage the web 100 after the withdrawal rolls to emboss or bond the web 100 with a pattern thereby providing a desired degree of stiffness and/or strength to the web 100.

At least one of the zones A, B and C of the web 100 shrink upon exposure to the heat. Because the fibers are intertwined, the shrinking produces a gradient effect. The extent of shrinkage is dependent on a number of factors, including, but not limited to, the fiber composition, fiber diameter, fiber density, the overlap in zones, time of exposure to heat after web formation and setting, heated air temperature, duration of exposure to the heated air, distance of the manifold 130 from the web 100, and the like. Additionally, the heated air itself may have different variables associated therewith, such as but not limited to, temperature, humidity, acidity, and the like. The air source can contain vaporized water or other fluid. Such fluids may alter the chemical makeup of the fiber web and increase or decrease pore size or other characteristics. Moreover, the air source can also contain fibers, such as wood pulp, or particles, such as superabsorbent polymer ("SAP"), which when blown into the web 100 become entrapped either on the surface, or within the pores. In the case where the fibers or particles are partially melted, they can adhere and solidify on or in the web 100.

The resulting web 100 has a gradient of pore sizes across the width of the web. For example, if the die head 122 produces fibers of large (relative) denier, die head 124, produces fibers of medium denier, and die head 126 produces fibers of fine denier, then the resulting gradient will have fibers in zone A having the largest pore size, the fibers in zone B having smaller pore size, and the fibers in zone C having the smallest relative pore size.

In an alternative embodiment, the three die heads 122, 124, and 126 are replaced by a single die head 150 (not shown) having apertures of different diameters. By controlling the aperture size across the width of the die head 150, the denier of fiber created can be controlled.

Alternatively, it is possible to use an apparatus 200, shown in FIG. 6, in which a layer of fibers 210, composed of a polymer A, is deposited on a conveyor belt 212 by a first row of meltblown (or spunbond) dies (partially shown and noted collectively as 214), which are fed molten resin polymer A, as described hereinabove with respect to the assembly 111. A second layer of fibers 216, composed of a polymer B, is deposited on the conveyor belt 212 by a second row of meltblown dies noted collectively as 218, which are similarly fed molten resin polymer B. Vacuum boxes 219 and 219A positioned beneath the belt 212 draw the fibers formed onto the belt 212 during the process. Resulting laminate web 220 is subjected to heat in the manner described above using a manifold 230, which is connected by a conduit 232 to a heated air source 234. Optional boxes 236 can be inserted in the conduit 234. A vacuum box 237 assists in improving uniformity of heating through the web thickness. The advantage of using two or more polymers is that the heat shrinkage characteristics of each polymer can permit greater control over the pore size gradient formed thereby. Using polymers with very different heat shrinking characteristics may provide greater Z direction shrinking, which may produce a web having greater or less absorption or wicking properties.

A meltblown process may be advantageous where a smaller relative pore size range of the pre-shrunk web is to be created and a spunbonded process may be advantageous where a larger pore size range is to be achieved.

Figure 7:
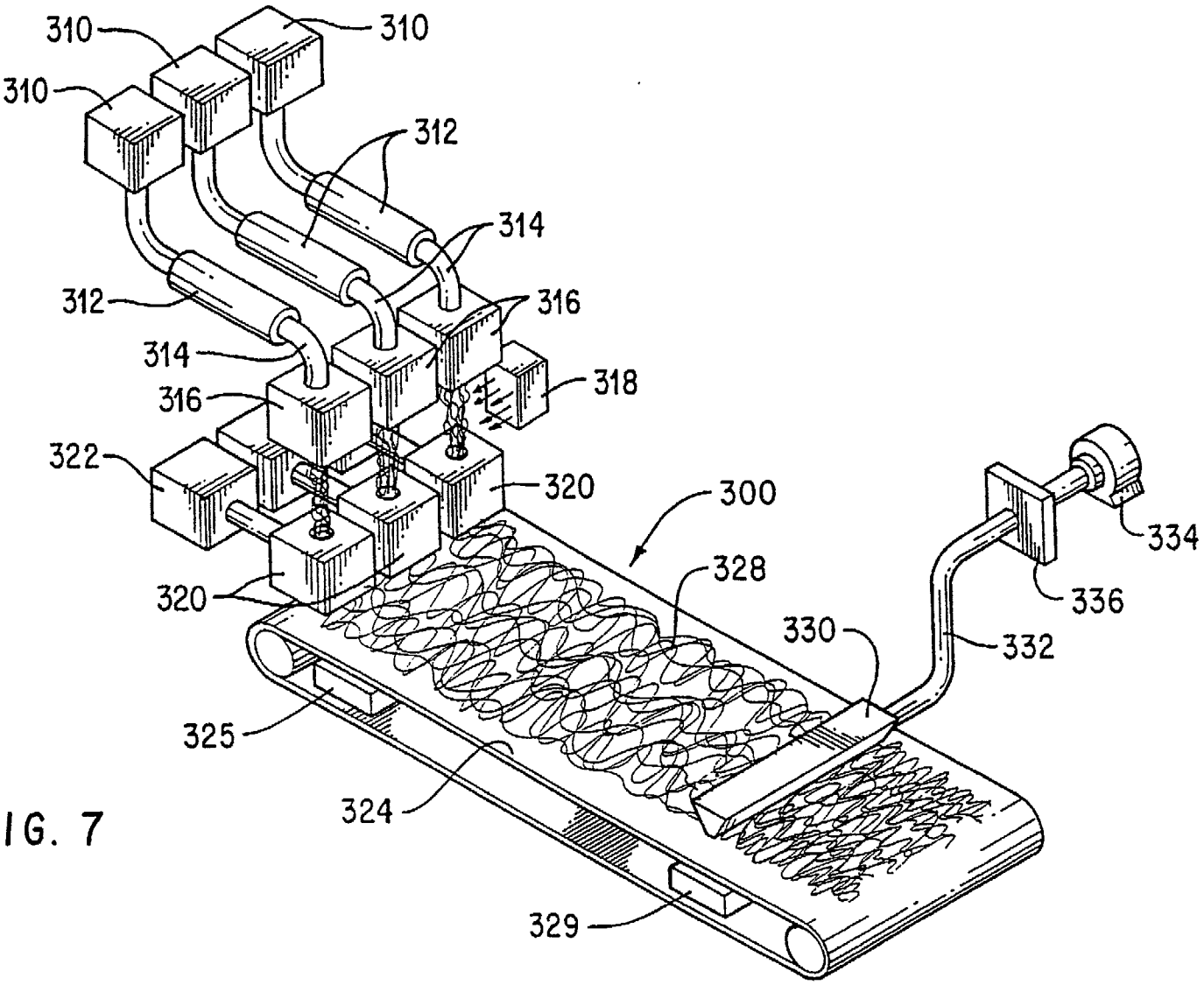
FIG. 7 shows a side view of a spunbond apparatus used to form a variable composition fiber web according to a second preferred embodiment of the present invention, using three spunbond dies.

As an alternative web-forming process to the second preferred embodiment, the present invention can be practiced with a spunbond process and apparatus. Spunbond web formation is known in the art and need not be reviewed in detail here. Briefly, however, FIG. 7 shows a perspective view of an apparatus 300, in which hoppers 310 feed polymer into extruders 312, which is then fed by pipes 314 into a spinneret 316. The spinneret draws the resin into fibers, which are quenched by a quench blower 318 positioned below each spinneret (one of which is shown in the drawing). A fiber draw unit or aspirator 320 is positioned below the spinneret 316 and receives the quenched filaments. It is to be understood that any number of spunbond extruder-spinneret assemblies can be used according to the present invention.

The fiber draw unit 320 includes an elongate vertical passage through which the filaments are drawn by aspirating air entering from the dies of the passage and flowing downwardly through the passage. A heater 322 (one of which is shown in the drawing) supplies hot aspirating air to the fiber draw unit 320. The hot aspirating air draws the filaments and ambient air through the unit 320. A foraminous collecting belt 324 receives the continuous filaments from the outlet Openings of the fiber draw unit 320 assisted by a vacuum box 325, to form a web 328. Optionally, calender rolls (not shown), can be employed in a conventionally known manner to apply pattern or overall bonding to the web 328.

After the web 328 has been formed, a heating manifold 330, as described hereinabove is used to apply heat to the web 328 and a vacuum box 329 is used, as described hereinabove. A pore gradient is thus formed in the web.

Figure 8:
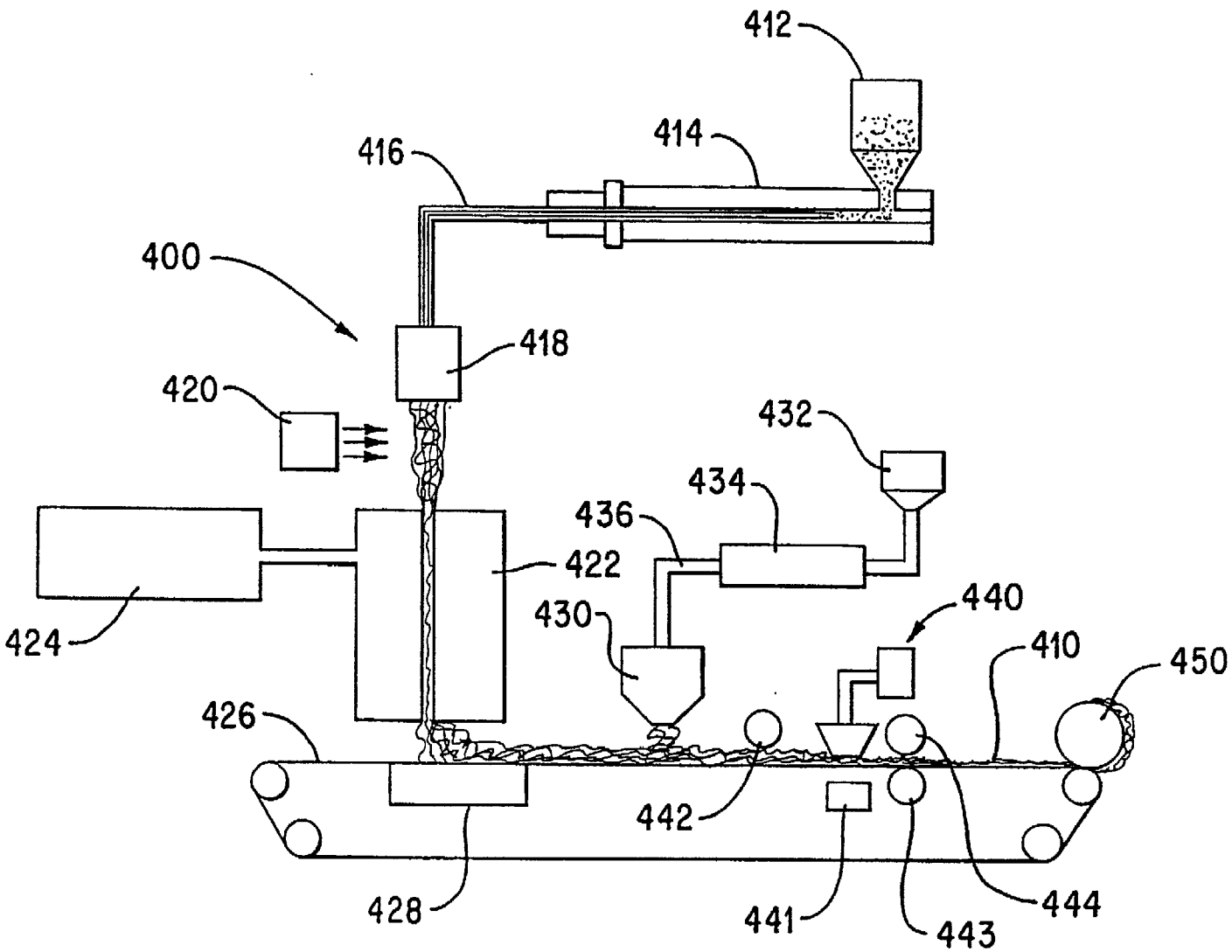
FIG. 8 shows a side view of an apparatus according to an alternative embodiment in which a layer of fibers is first deposited by a row of spunbond die assemblies followed by deposition of a second layer of fibers produced by a row of meltblown dies.

In further alternative embodiment to the second embodiment, a combination meltblown and spunbond process can be used to create a composite web that is shrunk using the heat source apparatus and method of the second embodiment. A composite of spunbond-meltblown-spunbond fibers, known as SMS, can be created and heat shrunk using the present invention. In such a process, a layer of meltblown fibers is formed on top of a layer of spunbond fibers and combined with a second spunbond layer to form a three layer laminate, which laminate is then pressed between a pair of calender rolls to form a unitary web. FIG. 8 shows an apparatus 400, which can form a spunbond-meltblown web 410. Hopper 412 feeds polymer pellets into an extruder 414. Extruded resin is fed by a pipe 416 into a spinneret 418, which forms filaments from the resin. A quench blower 420 is positioned adjacent the filament stream and quenches the filaments. The filaments are received into a fiber draw unit 422, which is supplied with hot air by a heater 424.

The filaments formed are drawn onto a foraminous collecting belt 426 by a vacuum box 428 positioned below the belt 426. A meltblowing die head 430, supplied with polymer resin from a hopper 432, via an extruder 434 and pipe 436 assembly, produces a layer of meltblown filaments which is deposited on the collecting belt 426 onto the spunbond layer of filaments. A heating manifold assembly 440 and vacuum box 441, as described in detail hereinabove, selectively heat shrinks the laminate web 410 to form a pore size gradient neck stretching roller assembly 442 and/or calender rolls 443 and 444 can be used as is known to those skilled in the art. A collecting roller 450 can remove and collect the finished product.

An advantage of the first embodiment of the present invention is that a conventionally formed web can be treated after formation to differentially create a pore size gradient. This method can reduce the necessity of creating new apparatus for forming the web. A pore gradient is advantageous in that the smaller the pore size the greater the wicking power of the web. A pore gradient structure is the most efficient structure for transporting liquid against gravity. Where smaller areas are to have a pore gradient, selective heat application to a homogenous pore size web can have a high degree of control over the shrinkage. A further advantage of this method is that addition of coforming particles provides additional control over web characteristics.

An advantage of the second embodiment is that control over the range of pore sizes achievable is much greater because there are two degrees of freedom with respect to control, i.e., web density and heat application.

EXAMPLES

The invention will be further described in connection with the following examples, which are set forth for purposes of illustration only. Parts and percentages appearing in such examples are by weight unless otherwise stipulated.

Example 1—Formation of Pore Gradient Structure from Homogenous Composition

A meltblown web (sample #5214) was made from PET in a conventional manner to form a substantially homogenous pore size distribution. For a detailed description of a method of forming a meltblown web, see Butin et al., U.S. Pat. No. 3,849,241. A sample of material was cut in the form of a truncated inverted triangle. Sections of the web sample were dipped in boiling water (100° C.) for 30 seconds to shrink selectively portions of the web. Alternatively, a spray head/manifold, extending substantially across the belt and the width of the web, is used to spray boiling water onto the web. The speed of the fiber on the belt passing below the manifold, and the length of the manifold, determine the length of exposure of the web to heat.

The method created a unitary structure with a pore size gradient.

Example 2—Analysis of Pore Gradient Structure and Control Samples of Example 1

The pore radius distribution chart of the formed unshrunk web is illustrated in FIG. 3, in which the x-axis shows pore radius in microns and the y-axis shows absorbence in ml/g, as determined by using an apparatus based on the porous plate method first reported by Burgeni and Kapur in The Textile and Research Journal, Volume 37 (1967), p. 356. The system is a modified version of the porous plate method and consists of a movable Velmex stage interfaced with a programmable stepper motor and an electronic balance controlled by a microcomputer. A control program automatically moves the stage to the desired height, collects data at a specified sampling rate until equilibrium is reached, and then moves to the next calculated height. Controllable parameters of the method include sampling rates, criteria for equilibrium, and the number of absorption/desorption cycles.

Data for this analysis were collected in an oil medium. Readings were taken every fifteen seconds; if, after four consecutive readings, the average change was less than 0.005 g/min, equilibrium was assumed to have been reached. One complete absorption/desorption cycle was used to obtain the reported data. The sample used was a 2.75 in. in diameter die cut sheet.

The pore radius distribution for the unshrunk sample peaked at 170μ. The pore radius distribution for the shrunk sample is shown in FIG. 4.

A vertical wicking technique involves partially submerging a long piece of sample fabric in a basin of fluid, and allowing it to hang vertically from above for a certain period of time. The depth of fabric in the fluid is not critical. The vertical wicking height is the height the fluid travels vertically up the fabric (measured from the fluid level of the fabric) after equilibrium has been reached. The equilibrium height is considered to be the maximum wicking height possible (reached after about one to two hours). The equilibrium times of the samples compared in this experiment were not necessarily equivalent.

An experiment was done using mineral oil g=27 dynes/cm, $\eta$=6 cps, where g is surface tension and $\eta$ is viscosity. The equilibrium vertical wicking heights for the pore gradient sample and the homogenous, unshrunk sample were as follows:

| Sample ID | Wicking distance | Corresponding radius |
|---|---|---|
| Shrunk sample | >15 cm | <45μ |
| Unshrunk sample | 7 cm | 95μ |

The values were consistent with the pore size distribution measured in the absorption mode.

Example 3—Method of Heat Treating the Homogenous Web Structure

The homogenous composition sample of Example 1 is subjected to a hot air stream across the surface of the web from a hot air source for a period of between about 5 seconds and 2 minutes at a temperature range of between about 100° C. to about 200° C. The stream is directed to selective portions of the web for different lengths of time. A smooth movement of the hot air source creates a smooth transition between portions.

Example 4—Method of Producing Variable Pore Size Gradient Structure from Variable Composition A variable composition web having different fiber diameters is made using polypropylene by a meltblowing process using three dies, each die extruding a different fiber diameter to form three zones. Alternatively, a single die having different aperture sizes across the die can be used. Zone fiber content, relative shrinkage, and pore size is as follows:

| Unit Zone No. | Composition | Shrinkage/pore size | Denier |
|---|---|---|---|
| 1 | Large fiber PET or 50/50 PET/polypropylene | Low shrinkage/ large pore size | 20–30μ |
| 2 | Medium fiber PET or 75/25 PET/polypropylene | Medium shrinkage/ medium pore size | 10–20μ |
| 3 | Fine fiber PET | High shrinkage/ small pore size | 2–5μ |

A sample of the web obtained is cut into an inverted truncated triangle. The sample is exposed uniformly to a heat source, such as hot air having a temperature preferably in the range of from about 150°–200° C. or boiling water for approximately 30 seconds. It is to be understood that these ranges are approximate and variations, expansion and narrowing of the ranges are usable and contemplated as being within the scope of this invention. The resulting product has the greatest shrinkage and therefore smallest pore size in Zone 3, moderate shrinkage and medium pore size in Zone 2 and lowest shrinkage and largest pore size in Zone 1.

Example 5—Alternative Method of Central and Side Zones Creation

For material that can be manufactured into a diaper or the like, along a length of the web to be formed Zone 1, the central zone, is made of large fiber PET; Zones 2 and 3, on either side of Zone 1, are made of medium or fine fiber PET or PET/polypropylene mixture. After application of the heat source, the central Zone 1, where fluid contact and absorption flux is greatest, has a large pore size. The side Zones 2 and 3, which wick fluid away from the central Zone 1, have smaller pore sizes.

Figure 6:
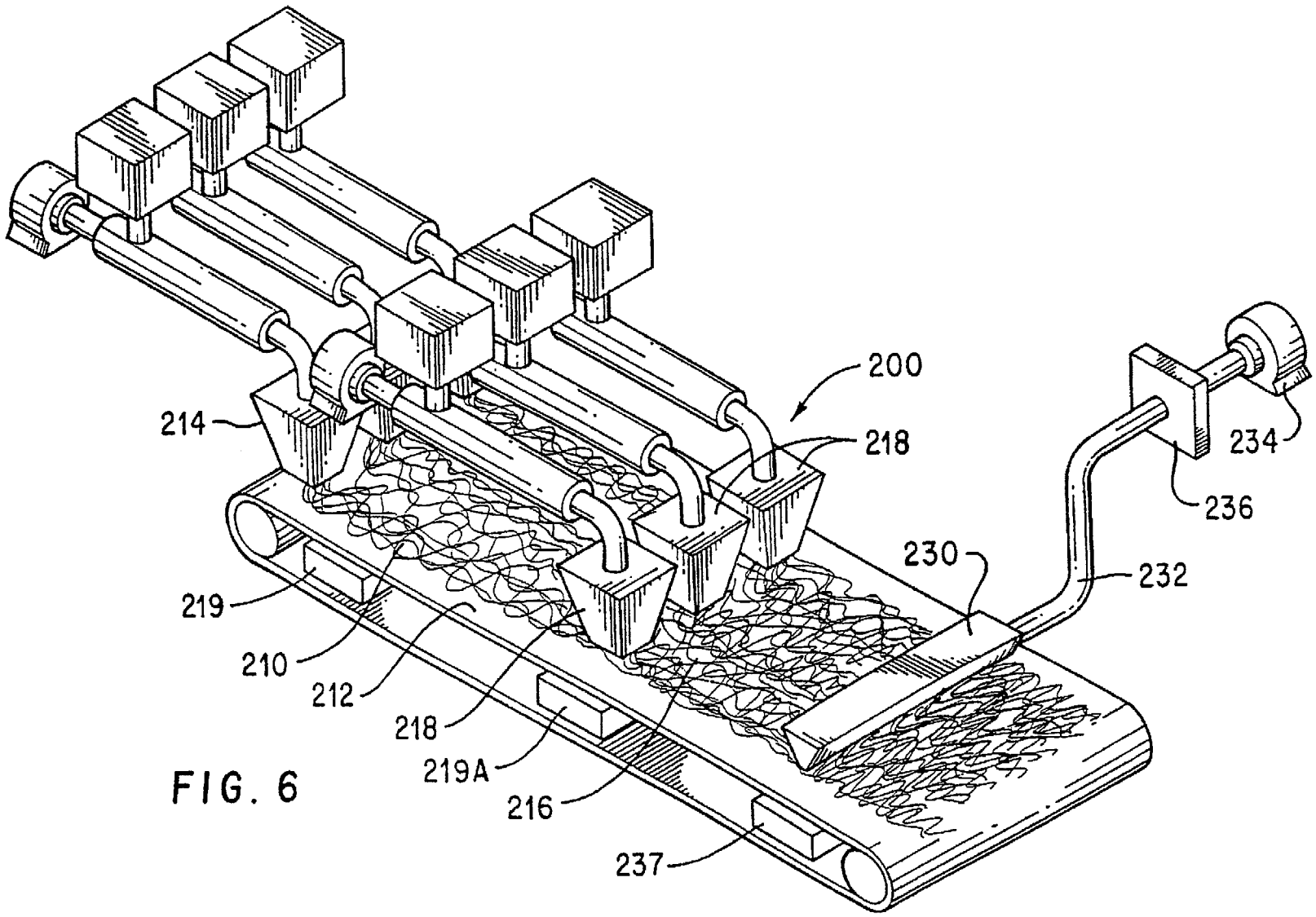
FIG. 6 shows a pictorial view of an apparatus, wherein one row of meltblown dies form a first layer of fibers and a second row of meltblown dies produce fibers which overlay the first layer of fibers, producing a laminate structure.

Example 6—Method of Producing a Variable Pore Size Gradient Structure from a Mixture of Fibers Using Meltblown Process An apparatus as shown in FIG. 6 is used in which fibers meltblown from one polymer A are formed by three dies and deposited across and onto a belt. While the A polymer fibers are still molten, fibers meltblown from a polymer B are deposited by separate dies on top of the A polymer such that the fibers mix and become entrained. After the mixed A and B fibers web is formed, it is subjected to a heat source, as described in the previous Examples. The multi-component web thus formed has a pore size gradient that can be controlled by the structure and composition of each fiber A and fiber B used.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A method of forming a nonwoven fiber structure having a pore size gradient, comprising:

(a) providing at least one polymer resin capable of forming thermally responsive fibers;

(b) forming a plurality of fibers from said resin;

(c) forming a nonwoven fiber web from said fibers, said web having an average pore size;

(d) selectively applying a heat source to said web such that a portion of said fibers shrink to form an average pore size smaller than that of said average pore size in step (c).

2. The method of claim 1, wherein said polymer is a thermoplastic polymer.

3. The method of claim 2, wherein said polymer is selected from the group consisting of polymers and copolymers of ethylene, propylene, ethylene terephthalate and mixtures thereof.

4. The method of claim 1, wherein said fibers are formed in step (b) by a meltblown process.

5. The method of claim 1, wherein said fibers are formed in step (b) by a spunbond process.

6. The method of claim 1, wherein said fibers are selected from the group consisting of mono-component and multi-component fibers.

7. The method of claim 6, wherein said multi-component fibers are selected from the group consisting of sheath/core, eccentric sheath/core, side by side, and islands-in-the-sea arrangements.

8. The method of claim 1, wherein said fibers formed have an average diameter of from about 0.1μ to about 100μ.

9. The method of claim 1, wherein said fibers formed have an average diameter of from about 1.0μ to about 5.0μ.

10. The method of claim 1, wherein said web formed in step (c) has an average pore size of from about 5μ to about 1000μ.

11. The method of claim 4, wherein said web formed in step (c) has an average pore size of from about 5μ to about 20μ.

12. The method of claim 5, wherein said web formed in step (c) has an average pore size of from about 200μ to about 700μ.

13. The method of claim 1, wherein said web formed in step (c) has an average pore size of less than about 50% variation.

14. The method of claim 1, wherein said fibers are co-formed with a material selected from the group consisting of fibers, wood pulp, particulate matter and superabsorbent polymer (SAP).

15. The method of claim 1, wherein said heat source is selected from the group consisting of a fluid, air, solid and particulate material.

16. The method of claim 15, wherein said fluid is selected from the group consisting of water and oil.

17. The method of claim 1, further comprising step (e) quenching said web.

18. The method of claim 1, wherein said web is produced by a combination of meltblown and spunbond processes.

19. A nonwoven fiber structure having a pore size gradient produced according the method of claim 1.

20. A method of forming a nonwoven fiber structure having a pore size gradient, comprising:

(a) providing at least one polymer resin capable of forming thermally responsive fibers;

(b) forming a plurality of fibers from said resin;

(c) forming a nonwoven fiber web from said fibers, said web having an average pore size and having a variable structure of at least two fiber characteristics each of said at least two fibers being in a zone; and, (d) selectively applying a heat source to said web such that at least a portion of said fibers shrink to produce zones having different average pore sizes.

21. The method of claim 20, wherein said polymer is a thermoplastic polymer.

22. The method of claim 21, wherein said polymer is selected from the group consisting of polymers and copolymers of ethylene, propylene and ethylene terephthalate and mixtures thereof.

23. The method of claim 20, wherein said fibers are formed in step (b) by a meltblown process.

24. The method of claim 20, wherein said fibers are formed in step (b) by a spunbond process.

25. The method of claim 20, wherein said fibers are selected from the group consisting of mono-component and multi-component fibers.

26. The method of claim 25, wherein said multi-component fibers are selected from the group consisting of sheath/core, eccentric sheath/core, side by side, and islands in the sea arrangements.

27. The method of claim 20, wherein said fibers formed have an average diameter of from about 0.1μ to about 100μ.

28. The method of claim 20, wherein said fibers formed have an average diameter of from about 1.0μ to about 5.0μ.

29. The method of claim 20, wherein said web formed in step (c) has an average pore size of from about 5μ to about 1000μ.

30. The method of claim 23, wherein said web formed in step (c) has an average pore size of from about 5μ to about 20μ.

31. The method of claim 24, wherein said web formed in step (c) has an average pore size of from about 200μ to about 700μ.

32. The method of claim 20, wherein said web formed in step (c) has an average pore size of less than about 50% variation.

33. The method of claim 20, wherein said fibers are co-formed with a material selected from the group consisting of fibers, wood pulp, particulate matter and superabsorbent polymer (SAP).

34. The method of claim 20, wherein said heat source is selected from the group consisting of a fluid, air, solid and particulate material.

35. The method of claim 20, wherein said fluid is selected from the group consisting of water and oil.

36. The method of claim 20, wherein said web is made of at least one shrinkable fiber and at least one non-shrinkable fiber.

37. The method of claim 20, further comprising step (e) quenching said web.

38. The method of claim 20, wherein said at least two zones have a smooth transition.

39. The method of claim 20, wherein said heat is applied in a uniform manner.

40. The method of claim 20, wherein said heat is applied to selective portions of the web.

41. The method of claim 20, wherein said web is produced by a combination of meltblown and spunbond processes.

42. The method of claim 20, wherein a plurality of polymer resin compositions capable of forming thermally responsive fibers are each extended through a discrete meltblown die so as to form a plurality of fibers having an average pore size and having a variable structure of at least two fiber characteristics each of said at least two fibers being in a discrete zone.

43. A nonwoven fiber structure having a pore size gradient formed by the process of claim 20.

44. A nonwoven fiber structure having a pore size gradient formed by the process of claim 42.

45. An apparatus for forming a nonwoven fiber web of varying fiber structure having a pore gradient, comprising:

(a) at least two hoppers each capable of containing an amount of a resin material;

(b) at least two dies, each die having at least one aperture;

(c) means for placing said hoppers in communication with said dies, each reservoir being in communication with at least one die;

(d) means for forming thermally responsive fibers from said dies;

(e) means for collecting said fibers as a web comprising a moving foraminous belt; and (f) a heat source means associated with said apparatus for applying heat to said web such that said fibers selectively shrink, with a portion of said fibers having a smaller pore size than said unshrunk fibers.

* * * * *

UNITED STATES PATENT AND TRADEMARK OFFICE

CERTIFICATION OF CORRECTION

PATENT NO. : 5,679,042

DATED : October 21, 1997

INVENTOR(S): Varona

It is certified that errors appear in the above-identified patent and that said Letters Patent is hereby corrected as shown below:

Column 6, line 49, "et al," should read --et al.,--;
Column 6, line 57, "116 The" should read --116. The--;
Column 8, line 45, "passage," should read --passage.--;
Column 8, line 50, "Openings" should read --openings--;
Column 12, line 51, "according the" should read --according to the--;
Column 13, line 12, "side by side" should read --side-by-side--;
Column 13, line 13, "islands in the sea" should read --islands-in-the-sea--.

Signed and Sealed this

First Day of December, 1998

*Attest:*

Bruce Lehman

BRUCE LEHMAN

*Attesting Officer*

*Commissioner of Patents and Trademarks*